US005384203A

United States Patent [19]

Apfel

[11] Patent Number: 5,384,203

[45] Date of Patent: Jan. 24, 1995

[54] FOAM METALLIC GLASS

[75] Inventor: Robert E. Apfel, New Haven, Conn.

[73] Assignee: Yale University, New Haven, Conn.

[21] Appl. No.: 14,206

[22] Filed: Feb. 5, 1993

[51] Int. Cl.[6] ..... B22D 25/06; B22D 27/15

[52] U.S. Cl. ..... 428/613; 164/61; 164/62; 164/79; 264/53

[58] Field of Search ..... 428/613; 75/415; 164/61, 62, 79; 264/53; 148/403, 304

[56] References Cited

U.S. PATENT DOCUMENTS

| | | | |
|---|---|---|---|
| 2,434,775 | 1/1948 | Sosnick | 428/613 |
| 3,592,628 | 7/1971 | Wuenscher | 428/613 |
| 3,725,318 | 4/1973 | Bengtson | 264/53 |
| 3,970,732 | 7/1976 | Sloats et al. | 264/53 |
| 4,096,218 | 6/1978 | Yasuike et al. | 264/53 |
| 4,454,087 | 6/1984 | Hayashi et al. | 264/53 |
| 4,598,101 | 7/1986 | Krutchen et al. | 264/53 |
| 4,743,417 | 5/1988 | Bakkelunn | 264/53 |
| 4,834,816 | 5/1989 | Hasegawa et al. | 148/304 |
| 4,939,296 | 7/1990 | Franzen et al. | 562/415 |
| 5,181,549 | 1/1993 | Shapovalov | 164/79 |

FOREIGN PATENT DOCUMENTS

| | | | |
|---|---|---|---|
| 2282479 | 3/1976 | France | 75/415 |

OTHER PUBLICATIONS

L. Polonsky et al., "Lightweight Cellular Metal", American Foundry Society Transactions, vol. 69, 1961, pp. 65–79.

Luborsky, F. E., Ph.D., "Amorphous Metallic Alloys", Butterworths Monographs in Materials, 1983, Chapter 1, pp. 1–7.

Davies, H. A., "Metallic Glass Formation", Butterworths Monographs in Materials, 1983, Chapter 2, pp. 8–25.

*Primary Examiner*—John Zimmerman

*Attorney, Agent, or Firm*—Fish & Richardson

[57] ABSTRACT

A method of making a solid foam material including the steps of heating in a chamber a starting material that is normally solid at room temperature to a temperature that is above its melting point, injecting a blowing liquid into the melted material to produce a mixture; and rapidly decompressing the mixture to produce the solid foam material.

16 Claims, 2 Drawing Sheets

FOAM METALLIC GLASS

BACKGROUND OF THE INVENTION

The invention relates to metallic glasses.

It has long been desirable to engineer metallic materials that possess the properties of strength and durability without paying the penalty of excessive weight. To overcome the problems of mechanical failures due to dislocations and grain boundaries and to produce desirable magnetic and electrical properties, materials scientist have experimented with producing metallic glasses through the rapid quenching of thin streams of materials. The ribbons produced are typically no greater than 0.5 mm thick and have many desirable properties (mechanical and magnetic), but they are not bulk materials (i.e. having as-cast configuration) exhibiting bulk properties.

It has been about 30 years since Paul Duwez and colleagues demonstrated that metallic glasses from the melt can be produced using his "gun technique" if the quench rate was sufficiently rapid (e.g. $\sim 10^6$ K/S) (See P. Duwez, R.H. Willens, and W. Klement, Jr., J. Appl. Phys. 31, 135 (1960)). Since that time much experimental and theoretical work has disclosed the conditions necessary to produce and maintain the metallic glass ("amorphous") state. David Turnbull has been among the leaders in the field. His work in the late 40's with metal alloy (mercury) drops and that of Vonnegut with oxide coated tin drops demonstrated that the undercooling of metallic materials followed a path similar to non-metallic materials. (See D. Trumbull, J. Appl. Phys. 20, 817 (1949) and B. Vonnegut, J. Colloid Sci. 3, 563 (1948)). Deep undercoolings were possible if heterophase nucleants were either absent or neutralized. Even relatively large samples (e.g. a few grams) could be undercooled if nucleants were removed by appropriate fluxing techniques.

In order for a glass to form, the melt must reach the glass forming temperature, $T_g$, before crystal nucleation can occur. The material must thus undercool below the liquidus temperature, $T_l$, in order to reach $T_g$. The reduced glass temperature ratio $T_{rg}=T_g/T_l$ becomes an important parameter.

The homogeneous nucleation rate decreases with increased $T_{rg}$ showing the desirability of choosing metallic liquids for which $T_g$ is as close to $T_l$ as possible.

Liquid metals, unlike non-metallic liquids, require negligible thermal activation for the nucleation of crystallization, thereby making glass formation difficult, if not impossible without the addition of impurity admixtures that are chosen to necessitate a redistribution by partition or local reordering thus preventing crystallization in time periods for which the viscosity of the melt can approach $10^{13}$ poise. These admixtures of impurities play another important role, namely, stabilizing the resultant glass against subsequent crystallization and substantial recalescence.

Among the techniques for producing metallic glasses from the melt are: splat quenching, melt spinning, and melt atomization — all depending on a large surface area in order to achieve a high quench rate. Alternately, amorphous materials have been produced by sputtering, vapor deposition, and self-substitute quenching. These techniques are reviewed by H.H. Liebermann, in "Sample Preparation: Methods and Process characterization," *Amorphous Metallic Alloys*, ed. Luborsky, Butterworth Monographs in Materials, 1983, pp. 1–7. In the ion implantation approach, effective substrate quench rates of $10^{14}$ K/s have been achieved. This surface modification technique allows for the surface treatment of metals, providing surfaces with the potential for high corrosion resistance.

Metallic glass applications also include mechanical property improvements (hardness, fracture strength, ductility, toughness). Yet with the present restrictions on sample thickness — in ribbons and foils — there is relatively low resistance to cycle fatigue under tension. The ribbons have found important application in electrical transformer core windings and motors because of their soft magnetic behavior and low magnetic hysteresis losses, with a world potential energy savings of perhaps $2\times10^{10}$ kWk per year.

One of the major problems with the present state of the art in metallic glass formation is in producing bulk, as-cast configurations. Amorphous metal powder consolidations are one potential solution to this problem, but suffer from many of the traditional shortcomings of composite materials. The present invention offers an alternative approach, namely, producing metallic "foams", i.e., open solid structures that may possess glass properties, low density, and the ability to take on bulk (as-cast) configurations.

SUMMARY OF THE INVENTION

Proposed here is the production of bulk metallic "foams" by the sudden decompression of a melt that is heavily seeded with a volatile liquid. This dispersed "foaming" liquid will vaporize upon decompression, taking its latent heat of vaporization from the melt, thereby adiabatically and homogeneously cooling it. If the cooling rate is sufficiently great (say, one million degrees Celsius per second), the possibility of producing a foam metallic glass exists.

In general, in one aspect, the invention is method of making a solid foam material. The method includes the steps of heating in a chamber a starting material that is normally solid at room temperature to a temperature that is above its melting point, injecting a blowing liquid into the melted material to produce a mixture; and rapidly decompressing the mixture to produce the solid foam material.

Preferred embodiments include the following features. The starting material is an organic material, a metallic material, an organo-metallic material, or a metallic alloy material. The method further includes the step of increasing the pressure of a gas in the chamber prior to injecting the blowing liquid. The pressure in the chamber is raised to a level that is high enough to prevent boiling of the blowing liquid when the blowing liquid is injected into the melted material. The method also includes the step of introducing an inert gas into the chamber prior to heating the starting material. The decompression step involves dropping the pressure surrounding the melted mixture to a pressure that is below the vapor pressure of the blowing liquid at the temperature of the melted material or to a pressure that no greater than about one atmosphere. In ome circumstances, the decompression step involves creating a partial vacuum around the melted mixture. In addition, the method may also include introducing a filler material into voids formed by the foam structure.

In general, in another aspect, the invention is a bulk solid foam material produced by the above-described method.

In general, in yet another aspect, the invention is a bulk metallic material having an uninterrupted foam glass and/or microcrystallite structure over dimensions greater than 1 mm in each of three orthogonal directions.

It appears that densities of less than 0.1 gram/cm$^3$ will be possible for the resulting bulk foam. Unlike a film of similar material, such a foam will have certain structural properties more appropriate to materials used in building objects that require strength and flexibility with low weight. Furthermore, the metallic glass bridges holding the resulting foam together could, depending on the alloy selected to make the foam, have strengths approaching metallic whiskers. And the entire foam, being made of many of these bridges, could have a durability to complement its strength and low density. The impact could be significant in several industries. The most obvious would be in transportation and space industries, where strength to weight ratios are of paramount importance. Moreover, if a factor of more than 30 in density can be achieved without sacrificing strength, applications could easily extend to other industries such as energy, chemical, agricultural, etc. In particular, the large surface area would suggest possible applications in catalysis. In addition, if the magnetic properties were appropriate, there will be applications in High Gradient Magnetic Separation flow through systems. Moreover, by filling the foam with materials, such as epoxy, ceramic or sand, one creates a material with a variety of applications. One might be a wing structure of an airplane, or a lightweight structure made in space, where the cost of the payload is directly related to its weight.

Other advantages and features will become apparent from the following description of the preferred embodiment and from the claims.

DESCRIPTION OF THE PREFERRED EMBODIMENTS

Structure and Operation

Figure 1:
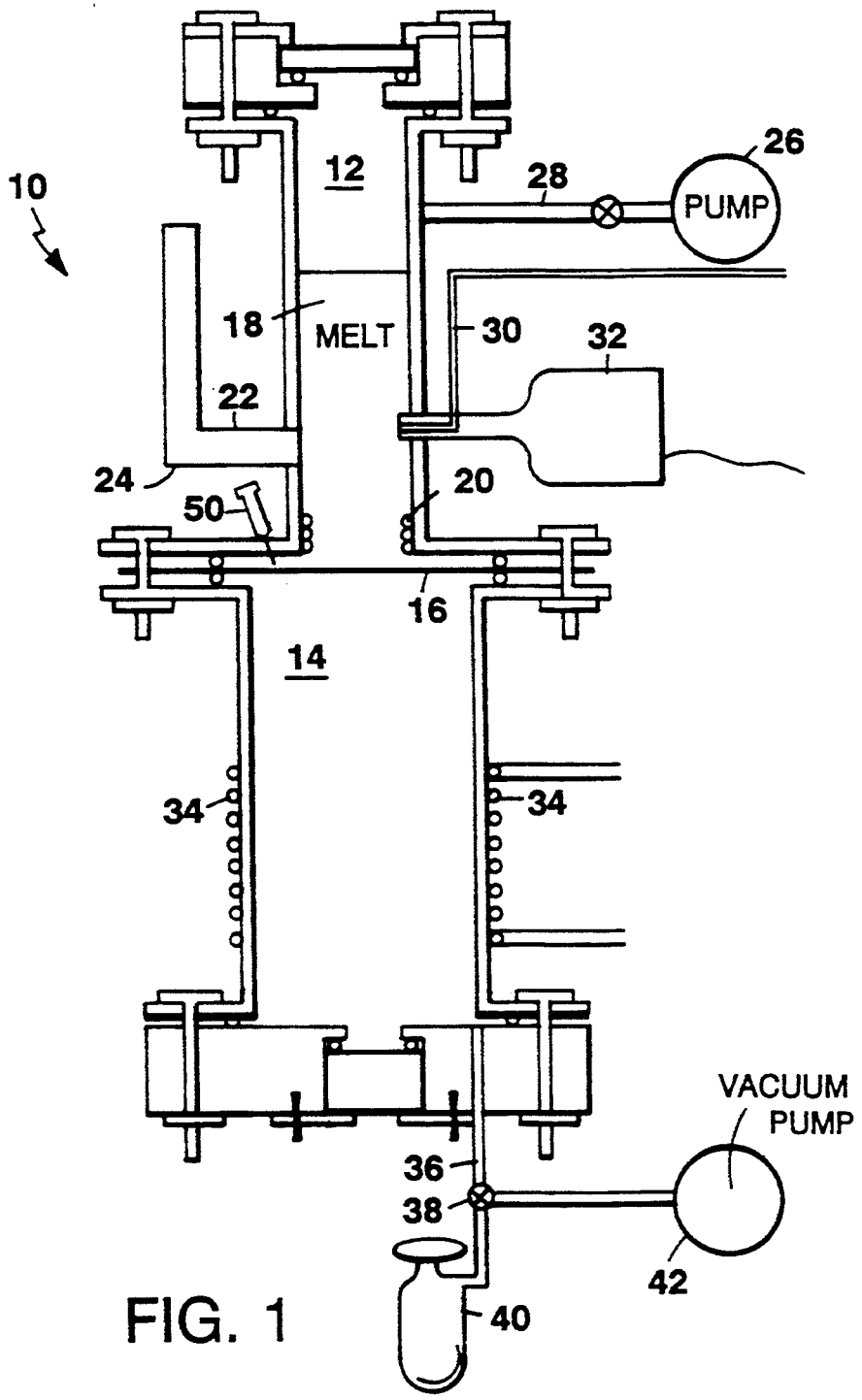
FIG. 1 shows a pressure cell adapted to produce foam metallic glass materials.

Described herein is a new idea for producing bulk metallic glass involving the sudden vaporization of liquid drops dispersed in molten metal near its melting temperature. The latent heat required for the drop vaporization results in the withdrawal of heat from the melt at a rate fast enough to drop the temperature sufficiently fast (e.g. $10^{6°}$ C./sec) to cause the rapid solidification of the metal. If certain parameter constraints are met, the result of this "homogeneous adiabatic cooling" is a metallic foam which will have a glass structure.

To illustrate the principles underlying the invention, an analysis based upon a quasi-static theory is presented. It yields rough estimates of the relevant factors and conditions required for producing a foam metallic glass in accordance with the invention. A more detailed analysis would require a considerably more complex dynamic analysis. The following analysis assumes a pressure cell with an internal smaller compliant vessel holding the melt material. Decompression occurs by opening a valve to release the pressure in the cell.

The melt material (A) is assumed to have a melt (solidification) temperature $T_M{}^A$. This is essentially the liquidus temperature, $T_l$. The drop material (B) (i.e., the blowing liquid) is assumed to have a boiling temperature at the pressure at which vaporization occurs of $T_b{}^B$. That material has critical pressures and temperature of $P_C{}^B$ and $T_C{}^B$. In general, there are four distinct phases in the metallic foam process, each specified by corresponding pressure and temperature conditions.

In the first phase, a metallic material A which is in melt form is held in an appropriately compliant and inert container (with appropriate atmosphere) in a pressure cell of much larger dimensions. During this phase, the pressure is atmospheric and the temperature T is slightly higher than $T_M{}^A$ and is less than $T_C{}^B$.

During the second phase, a liquid B is introduced into the melt within the chamber under pressure. During the second phase, the temperature is about equal to $T_M{}^A$, which is less than $T_b{}^B$. The pressure P of the liquid at $T=T_b{}^B$ is as follows: $P_C{}^B>P>P_b{}^B$, where $P_b{}^B$ is the vapor pressure of the blowing liquid at temperature $T=T_b{}^B$.

In the third phase, the melt and drop material is mixed to produce a dispersion of small drops (1–100 μm diameter in the melt). During this phase, the temperature and pressure conditions are the same as those during the second phase.

Finally, in the fourth phase, the chamber is decompressed rapidly back to atmospheric pressure. When this happens, the drops superheat and then vaporize suddenly leading to simultaneous foaming and cooling (from the latent heat effect).

The following quasi-static analysis gives some idea of the dynamic processes involved in the above-outlined process. First assume that drops of the volatile phase are uniform (of radius $R_d$) and are dispersed homogeneously in a melt phase of total volume, $V_m$. Also assume no significant chemical interactions between phases in a time period relevant to the process. The volume fraction of the volatile phase in the melt phase is $$X = \frac{N \cdot \frac{4}{3}\pi R_d{}^3}{V_m}, \tag{1}$$

where N is the number of drops.

In order to simplify the analysis greatly, each drop is assumed to be surrounded only by its share of melt $V_o=V_m/N$, in the form of a spherical shell of inner radius $R_d$ and outer radius $R_m$:

$$V_o = \frac{V_m}{N} = \frac{4}{3}\pi(R_m{}^3 - R_d{}^3). \tag{2}$$

A design goal is to achieve a certain rate of temperature drop $dT/dt=(\Delta T/\Delta t)$, where T is the temperature in the melt, $\Delta T$ is the temperature drop, and $\Delta t$ is the time. For simplification, it is assumed that the process of thermal equilibrium happens so fast that the temperature, T, in the melt volume $V_o$ is uniform.

The reduction in temperature is due to the latent heat of the drop material and the latent heat of fusion and specific heat of the melt as given by:

$$\Delta T \times (C_p)_m \cdot \overline{\rho}_m V_o = \overline{L}_v \cdot \overline{\rho} \cdot \frac{4}{3}\pi R_d{}^3 - \overline{L}_f \cdot \overline{\rho}_m V_o \tag{3}$$

Here $L_v$ is the average latent heat of vaporization of the drop material, and $L_f$ and $(C_p)_m$ are the average latent heat of fusion and specific heat of the melt material. $\rho_m$ and $\rho$ are the average densities of the melt and drop material, respectively. (Note that the specific heat of the drop material has been neglected, as it will be negligible compared to the latent heat of vaporization contribution to the energy balance. In a more complete analysis, this contribution would be included.) The ratio of the mass of melt material to that of drop material, corresponding to a temperature change of $\Delta T$, is:

$$\frac{M_m}{M_d} \quad \frac{\bar{\rho}_m V_o}{\left(\frac{4}{3}\pi R_d^3\right)\bar{\rho}} = \frac{\bar{L}_v}{[\Delta T(C_p)_m + \bar{L}_f]} \tag{4}$$

The time, $\Delta t$, for a drop of radius $R_d$ to vaporize can be estimated from Rayleigh by the following formula:

$$\frac{dR}{dt} = \sqrt{\frac{2}{3}\ \frac{\Delta P}{\bar{\rho}_m}} \tag{5}$$

or approximately, $$R_f = \sqrt{\frac{2}{3}\ \frac{(\overline{P_v(T)} - P_o)}{\bar{\rho}_m}}\ \Delta t,$$

where $R_f$ is the final bubble size, $\overline{P_v(T)}$ is the vapor pressure averaged over temperature, $P_o$ is the ambient pressure, and $\bar{\rho}_m$ is average melt density (Note that the rate will probably be higher since the average density surrounding the vaporizing drop is lower than the melt density.) The final bubble size is related to the initial drop size, $R_d$, by:

$$R_f = R_d\left(\frac{\rho_{vapor}}{\rho_{liquid}}\right)^{-\frac{1}{3}};\ (\rho_{liquid} \simeq \bar{\rho}) \tag{6}$$

From Eqs. (5) and (6), the time, in terms of other parameters, is equal to:

$$\Delta t = R_d\left[\frac{\rho_{vapor}}{\bar{\rho}}\right]^{\frac{1}{3}}\left[\frac{3\bar{\rho}_m}{2(\overline{P_v(T)} - P_o)}\right]^{\frac{1}{2}} \tag{7}$$

With this background, the following question can now be answered. What must the ratio of drop to melt mass be if $\Delta T/\Delta t$ is to achieve the criterion $T^*$, which might be of the order of $10^6$ K/sec or higher?
Or substituting:

$$\Delta T = \dot{T}^*\Delta t = \dot{T}^* \cdot R_d\left[\frac{\rho_{vapor}}{\bar{\rho}}\right]^{\frac{1}{3}}\left[\frac{3\bar{\rho}_m}{2(\overline{P_v(T)} - P_o)}\right]^{\frac{1}{2}} \tag{8}$$

into Eq. 4 yields:

$$\frac{M_d}{M_m} = \frac{\left\{(C_p)_m \cdot T^* \cdot R_d\left[\frac{\rho_{vapor}}{\bar{\rho}}\right]^{-\frac{1}{3}}\left[\frac{3\bar{\rho}_m}{2(\overline{P_v(T)} - P_o)}\right]^{\frac{1}{2}} + \bar{L}_f\right\}}{\bar{L}_v} \tag{9}$$

For a given $R_d$, this equation yields the amount of drop material required to transform one unit of melt to a foam. This value of $R_d$ that must be chosen comes from a consideration of initial conditions, the necessary temperature rate, and equations (5) and (6).

For instance, if a 40 celsius degrees temperature drop is necessary to reduce the initial melt temperature to a temperature at which the melt will solidify (not just supercool), and if $T^* = 10^{6\circ}$ C./s, then At in equation 5 is:

$$\Delta t = \frac{\Delta T}{T^*} = \frac{40}{10^6} = 4 \times 10^{-5} \text{ seconds}$$

It is instructive to look at a specific example. Consider the case of a tin melt containing water drops. Of course, pure tin does not possess the admixture of impurities necessary if glass forming is to be possible, but it has well known properties readily obtained from any standard chemistry reference handbook and it nicely illustrates the concepts outlined above. Handbook data reveal the following relevant properties for tin and water:

| | |
|---|---|
| **Relevant Tin Properties** | |
| Melting Temperature: | 232° C. |
| Specific heat: | 0.054 cal/g/°C. (at 25° C.) |
| | 0.039 cal/g/°C. (at 100° K.) |
| Latent heat of fusion: | 14.1 cal/g (at 100° K.) |
| Thermal Conductivity: | 0.64 Watts $cm^2$ °C. |
| Thermal Expansion Coeff.: | $20 \times 10^{-6}$ per °C. |
| Density of Solid: | 7.3 $g/cm^3$ |
| **Relevant Water Properties** | |
| Critical temperature: | 374° C. |
| Critical pressure: | 218 atm. |
| Sat. Vapor Press at 250° C.: | 35 atm. |
| Latent Heat of Vaporization: | ~350 cal/gram at 200–250° C. (at Sat. Vapor Pressure) |
| Density (at Sat. Vapor Press.) | ~0.9 $gram/cm^3$ |

From equations 5 and 6:

$$R_d = \left(\frac{\rho_{vapor}}{\bar{\rho}}\right)^{\frac{1}{3}} R_f = \left(\frac{\rho_{vapor}}{\bar{\rho}}\right)^{\frac{1}{3}}\sqrt{\frac{2}{3}\ \frac{(\overline{P_v(T)} - P_o)}{\rho_m}}\ \Delta t \tag{10}$$

$$R_d = \frac{1}{8}\sqrt{\frac{2}{3}\left(34 \times \frac{10^6}{6}\right)}\ 4 \times 10^{-5} \approx 0.1 \text{ cm} = 100\ \mu\text{m}$$

Note that $R_f$ is about 800 $\mu$m and the average growth rate of the bubble is (800–100) $\mu m \div 4 \times 10^{-5}$ sec=17.5 meters per second, well short of the velocity of sound in the melt. Substituting this result and other data into equation (9) yields for the drop-to-melt mass ratio:

$$\frac{M_d}{M_m} \simeq \frac{1}{20}$$

In the final "metallic foam" the volume of vapor to metal can be found from:

$$\frac{\rho_d \bar{V}_d}{\bar{\rho}_m \bar{V}_m} = \frac{1}{20}$$

$$\frac{\bar{V}_d}{\bar{V}_m} = \frac{\bar{\rho}_m}{\bar{\rho}_d} \cdot \frac{1}{20}$$

$$\frac{\bar{V}_v}{\bar{V}_m} = \frac{8^3}{20}\ \frac{\bar{\rho}_m}{\bar{\rho}_d} = 192,$$

where $\overline{V}_v$ is the volume of the water vapor (which is about 8× the original liquid water volume in this order of magnitude estimate).

The foam density is, then:

$$\rho_{foam} = \frac{M_{foam}}{V_{foam}} = \frac{M_m + M_d}{V_v} = \frac{\frac{M_d}{M_m} + 1}{\frac{192\ V_m}{M_m}}$$

$$\rho_{foam} = \frac{1 + \frac{1}{20}}{192/\rho_m}$$

$$\frac{6}{192} \approx 0.03 \text{ grams/cm}^3$$

Here, it has been assumed that the foam volume has a negligible contribution from the melt. Such a "foam" would be produced with a mass fraction of water to melt of 1/20, which is volume fraction of approximately $\frac{1}{3}$ to $\frac{1}{4}$.

Note that the significance of $T_{rg}$ is that the closer the glass temperature is to the liquidus temperature, the less heat has to be removed from the melt to get it to reach the glass temperature; therefore, the faster the process of glass formation. With alloys with deep eutectics and complex, asymmetric molecules plus admixtures, it will thus be easier to achieve the required cooling rate to form a glass.

A Pressure Cell Implementation:

Referring to FIG. 1, a system for making a foam metallic glass in accordance with the invention includes a pressure cell 10 having a small top chamber 12 and a larger bottom chamber 14 separated by a membrane 16. A metallic material 18, which was introduced into top chamber 12, is heated up to and maintained at a temperature above its melting point by a heating coil 20 located around the perimeter of top chamber 12 or by an internal heater (not shown). Temperature and pressure probes 22 and 24 extend into top chamber 12 thereby enabling a user to monitor both the temperature and pressure within top chamber during operation. A pump 26 connected to top chamber 12 through an inlet 28 enables the user to increase the pressure within the chamber to a level sufficient to prevent an injected blowing material from vaporizing prior to the decompression phase.

Pressure cell 10 can be constructed by appropriately modifying a commercially available pressure cell obtained from, for example, PARR Instrument Company of Moline Ill.

An operator injects the blowing material into top chamber 12 through an input line 30 with the aid of a high powered ultrasonic horn 32. Ultrasonic horn 32 acts to induce flows in the melt and thereby functions as a stirrer for mixing the injected blowing material throughout the melt. The ultrasonic horn is modified so that input line 30 passes through the end of the horn. As the top chamber may be pressurized, the blowing material must then be forced into top chamber 12 under an even greater pressure. As the blowing material enters top chamber 12, ultrasonic horn 32 breaks up the material into tiny droplets (e.g. micron size) and disperses the droplets throughout the melt to form a homogenized mixture.

Around the outside of bottom chamber 14 are cooling coils 34 which are used to reduce the temperature of the chamber prior to decompressing the melt/blowing material mixture. An inlet 36 into bottom chamber 14 is coupled through a solenoid operated valve 38 to an inert gas source 40 or a vacuum pump 42. In one position, solenoid operated valve 38 connects vacuum pump 42 to bottom chamber 14 so that the chamber may evacuated. In another positon, it connects gas source 40 to the chamber so that the chamber may be flooded with an inert gas after the decompression phase.

A membrane rupturing device 50, which is operable from outside the pressure cell, extends into top chamber 12. This device enables the user to rupture membrane 16 and thereby release the melt mixture into the evacuated bottom chamber 14 for the decompression. Membrane 18 can be Mylar or an aluminum (or other metal) foil, stretched as a diaphragm over a frame. Rupturing device 50 can be like the devices used in shock-tube, gas dynamic studies to tear the membrane used to separate a low pressure from a high pressure regions. Alternatively, the membrane material and thickness can be chosen such that when the pressure is raised in top chamber 12 to a specific value, the membrane fails (without requiring puncturing).

Figure 2:
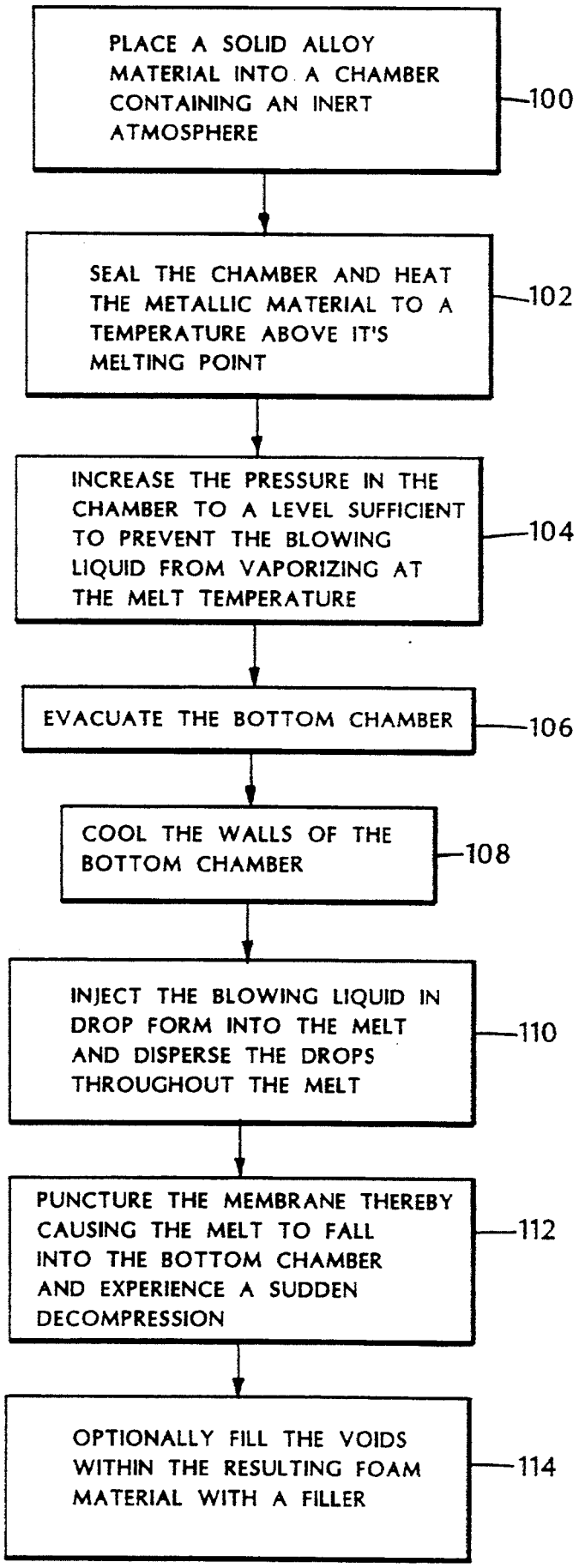
FIG. 2 is a flow chart of the steps for producing a foam metallic glass.

The Process Steps:

The steps of process for forming the foam metallic glass using the above-described system are shown in FIG. 2.

First, an operator floods top chamber 12 of pressure cell 10 with an inert gas at normal pressure and then places a solid alloy material into top chamber 12 (step 100). An appropriate inert gas might be, for example, argon or nitrogen. The operator then seals the top chamber and uses the heating coil to heat the material to a temperature just above its melting point (step 102). After the alloy has melted, the operator increases the pressure of the top chamber to a level sufficient to prevent the blowing liquid from vaporizing when it is introduced into the cell (step 104). The required pressure will be greater than the vapor pressure of the blowing liquid at the temperature of the melt. It can be quite large (e.g. 5 to 60 atmospheres) depending on the choice of blowing liquid that will be used.

At some point prior to the decompression phase of the process, the operator prepares the bottom chamber to receive the melt/blowing material mixture that is to be prepared in the top chamber. Using the vacuum pump and the cooling coils, the operator evacuates the chamber (step 106) and cools the walls of the chamber to aid in the removal of heat from the foamed material as it is being formed and to prevent reheating of the melt by the container walls (step 108). Holding the vacuum chamber at a low temperature aids in extracting heat from the foam material that is produced during the decompression.

After the pressure in the top chamber reaches the appropriate level and the bottom chamber is ready to receive the melt mixture, the operator injects the blowing liquid in drop form into the melt (step 110). The drops should be sufficiently small to slow the separation process and they should be well dispersed to yield a uniform material. It may be desirable at this stage to introduce with the blowing liquid, or in some other way, additional components such as admixtures (fluxes) for the melt or surface active materials to coat the drops to discourage drop coalescence and minimize surface nucleation of the crystalline phase.

After the blowing material has been adequately mixed into the melt, the operator tears or ruptures the membrane separating the pressurized top chamber and the evacuated bottom chamber (step 112). This causes the melt to fall into the bottom chamber and experience a sudden and large decompression around the melt mixture. This rapid decompression causes the blowing liquid to boil homogenously throughout the melt in turn causing the melt to rapidly expand and cooling it (by taking its latent heat of vaporization from the melt). The melt will undercool and reach the glass forming temperature before the alloy has a chance to crystallize.

The final product is a bulk foam metallic glass having an open structure which may be retrieved from the bottom chamber. If the process is not sufficiently fast, the structure may be composed of a mixture of glass and microcrystallites, with the proportions of each depending upon the process conditions during formation. Such materials may also be of interest. Microcrystalline structures (i.e., materials made up of microcrystallites) are materials having a periodic structure (e.g. as in crystals) over distances on the order of 10's of atomic distances (e.g. 10 to 100 atomic distances) and with that periodic structure breaking down at greater distances. For the distinction between amorphous (e.g. glass) and microcrystalline see for example a discussion by Frans Spaepen in "A New Look at Amorphous versus Microcrystalline Structure, " Materials Research Society Symposium, Vol 132 (1989) (pp. 127–135).

By a systematic variation of the parameters, e.g. melt temperature, rate of mixing, and operating pressure, the properties of the resulting foam can be optimized. For example, the operator may purge the pressure cell with a cool inert gas (or possibly even a liquid) after the foaming process is complete in order to suppress oxidation and other undesired effects at the enlarged metallic surface area of the foam. It may also be useful to release the gas pressure in the top chamber just prior to rupturing the membrane to enhance the sudden drop in pressure which occurs when the membrane is ruptured. This could be accomplished by opening a large cross-section valve to chamber.

Also, after the solid foam material is produced, one may optionally fill the voids within the foam structure with either a liquid or solid filler (step 114)

Examples of Materials for Forming Foams

One glass forming alloy that fits the requirements with water as the blowing liquid is the ternary $Au_{55}Pb_{22.5}Sb_{22.5}$. Its liquidus temperature is 250°–60° C. and its glass temperature is about 45° C. It is quite resistant to crystallization and may be reheated to about 65° C. before it begins to crystallize.

The more common alloy glasses formed from cheaper metals exhibit liquidus temperatures in the 800°–1000° C. range and glass temperatures in the 300°–500° C. range. For these alloys, some molten salt — e.g. $ZnCl_2$ or $SnCl_2$ — rather than water would have to be used as the foaming agent.

It is of course necessary that compatible drop and melt materials are used so that the parameter conditions of the first three steps are realized.

Also note that with water as a "blower/cooling" agent, the cooling rate will tend to slow down as water reaches 100° C. If the vessel that holds the melt/water mixture is itself warm, this will further compromise the permanence of the cooling process. To deal with this when water is used as a blower/cooling agent the pressure vessel holding the melt can be connected by a membrane to a cooled vacuum reservoir of considerably larger size. Then upon breaking the membrane, the entire contents would decompress into a larger cool container (see more detailed description below).

By decompressing to a vacuum, the water will continue to evaporate well below 100° C. By decompressing into a cool container, problems of reheating and sample recrystallization are minimized. In addition, using a reservoir that is much larger than the melt-water initial mixture, addresses the size limitations of the pressure cell which also limit the potential yield of the foamed product.

In selecting melt and blowing materials, it is important to avoid fast chemical reactions, e.g. oxidation, hydration, chlorination, and explosive potential. To diminish oxidation rates for example, it would be desirable to use an inert gas (e.g. Ar). Following decompression into an evaculated chamber, a low density foam of high surface area will result. To inhibit reactions at the surfaces, at least temporarily, it may be useful to purge the chamber with an inert gas immediately after the reaction.

The prior art identifies many other materials which would be appropriate for producing a bulk foam metallic glass-like material in accordance with the invention. See for example, *Amorphous Metallic Alloys*, ed. Luborsky, Butterworth Monographs in Materials, 1983; U.S. Pat. No. 4,939,296, entitled "Process for the Production of Catalytically-Active Metallic Glasses"; and U.S. Pat. No. 4,834,816, entitled "Metallic Glasses Having a Combination of High Permeability, Low Coercivity, Low AC Core Loss, Low Exciting Power and High thermal Stability."

It should be recognized that admixtures and a higher complexity of the metal alloys improve the possibility of a mixture being a glass former, because they make more difficult, and thus delay, the crystallization process, allowing the melt to cool to the point that the viscosity is so high that crystals cannot form; i.e. a glass has formed. In addition, alloys with deep eutectics (the lowest temperature at which solidification will occur) are also desirable since the difference in the normal temperature of solidification and the glass temperature is minimized.

Also, the technique described herein can be applied to other materials besides metals so long as such materials generally satisfy the requirements described herein. For example, organic starting materials could be used to produce foam structures. Two such organic materials are orthoterphenyl and Quaterphenyl. Orthoterphenyl has been characterized by Greet and Turnbull in "Glass transition on o-Terphenyl," J. Chem. Phys. 46, 1243–1251 (1967). Its melting temperature is at 58° C. but its glass forming temperature is around −30° C. For this material, water would not work as a foaming fluid because of its vaporization parameters. A more appropriate foaming liquid would be, for example, a Freon ® such as 142*b* (1 chloro-1 difluoroethane), assuming, of course, has acceptable miscibility with o-terphenyl. In contrast, water would be an acceptable foaming liquid for 00'diphenylbiphenyl (Quaterphenyl) which has a melting temperature of 118° C.

Other organic materials which would represent good candidates are those which have larger, asymmetrical molecules from which it is harder to build a crystal. Atactic polystyrene is an example.

The blowing liquid must be chosen not only based on its boiling temperature, vapor pressure, etc., but also its potential chemical interaction with the melt. Water may oxidize some melt materials. Salts such as zinc chloride or tin chloride may have the right properties to be blowing liquids for some reasonable metallic alloys.

Other embodiments are within the following claims. For example, the above described system utilizing two chambers in a pressure cell is only one example of many other ways to perform the decompression. It would also be possible to perform the process in a single chamber in which case it may be desirable to use a thin-wall crucible of appropriate material (e.g. quartz or Teflon® in the case of a melt of organic material) with minimal thermal mass to hold the melt prior to decompression.

It should be readily apparent that outer space offers an environment with many factors particularly suited for producing the foam materials described herein. The practical realization of the above-described objectives will be aided by two special features of the microgravity-space environment. First, it is essential that there be a uniform dispersion of small drops of the "blowing" liquid in the melt. Since the two liquids will typically be of greatly different density, they will tend to separate quickly at normal gravity. The microgravity environment of space will inhibit this separation. Second, decompression to a relatively large evacuated and cooled chamber increases the chances of achieving the high cooling rates that are required. The environment of space provides the ideal large vacuum chamber The expansion chamber, or "vacuum dump" can make use of the environment outside the space vehicle to provide the unlimited vacuum pumping capacity to whatever size expansion chamber is considered desirable, practical, and safe.

What is claimed is:

1. A method of making a solid foam material comprising:

in a chamber heating a starting material that is normally solid at room temperature to a temperature that is above its melting point;

injecting a blowing liquid into the melted material to produce a mixture; and rapidly decompressing the mixture to vaporize the blowing liquid so that its latent heat of vaporization cools the starting material sufficiently to produce the solid foam material.

2. The method of claim 1 wherein the starting material is an organic material.

3. The method of claim 1 wherein the starting material is a metallic material.

4. The method of claim 3 wherein the starting material is an organo-metallic material.

5. The method of claim 3 wherein the starting material is a metallic alloy material.

6. The method of claim 1 further comprising increasing the pressure of a gas in said chamber prior to injecting the blowing liquid.

7. The method of claim 6 wherein the pressure increasing step increases the pressure to a level that is high enough to prevent boiling of the blowing liquid when said blowing liquid is injected into the melted material.

8. The method of claim 1 further comprising introducing an inert gas into said chamber prior to heating the starting material.

9. The method of claim 1 wherein said decompression step involves dropping the pressure surrounding the melted mixture to no greater than about one atmosphere.

10. The method of claim 1 wherein said decompression step involves creating a partial vacuum around the melted mixture.

11. The method of claim 1 further comprising introducing a filler material into voids formed by the foam structure.

12. The method of claim 1 wherein the solid foam material exhibits an amorphous and/or microcrystalline structure.

13. The method of claim 1 wherein the step of injecting comprises mixing the injected blowing liquid in the melted material to disperse the blowing liquid throughout said melted material.

14. A material comprising:

a bulk metallic material having an uninterrupted foam glass and/or microcrystallite structure over dimensions greater than 1 mm in each of three orthogonal directions.

15. The material of claim 14 wherein the bulk metallic material has an uninterrupted foam glass and/or microcrystallite structure over dimensions greater than 1 cm in each of three orthogonal directions.

16. The material of claim 14 wherein the metallic material is an organo-metallic material.

* * * * *

UNITED STATES PATENT AND TRADEMARK OFFICE

CERTIFICATE OF CORRECTION

PATENT NO. : 5,384,203

DATED : January 24, 1995

INVENTOR(S) : Robert E. Apfel

It is certified that error appears in the above-identified patent and that said Letters Patent is hereby corrected as shown below:

Col. 6, line 6, replace "At" with --Δt--

Col. 11, line 26, replace "chamber" with --chamber.--

Col. 11, line 27, replace "dump" with --dump,--

Signed and Sealed this

Thirtieth Day of January, 1996

*Attest:*

*Attesting Officer*

BRUCE LEHMAN

*Commissioner of Patents and Trademarks*